US005508777A

United States Patent [19]

Isokawa et al.

[11] Patent Number: 5,508,777

[45] Date of Patent: Apr. 16, 1996

[54] PHOTOSENSITIVE MATERIAL PROCESSING APPARATUS IN USE WITH A SOLID PROCESSING AGENT

[75] Inventors: Wataru Isokawa; Kenji Yamanouchi; Noriyoshi Suzuki; Toshihiko Watanabe, all of Hino, Japan

[73] Assignee: Konica Corporation, Tokyo, Japan

[21] Appl. No.: 323,761

[22] Filed: Oct. 17, 1994

[30] Foreign Application Priority Data

Oct. 21, 1993 [JP] Japan ..... 5-263761

[51] Int. Cl.[6] ..... G03D 3/02

[52] U.S. Cl. ..... 354/324; 430/450

[58] Field of Search ..... 354/324; 430/465, 430/450, 398, 399, 400, 458

[56] References Cited

U.S. PATENT DOCUMENTS

| | | | |
|---|---|---|---|
| 5,318,061 | 6/1994 | Saito | 354/324 X |
| 5,334,492 | 8/1994 | Wernicke et al. | 354/324 X |
| 5,351,103 | 9/1994 | Komatsu et al. | 354/324 |

FOREIGN PATENT DOCUMENTS

| | | |
|---|---|---|
| 0537788A2 | 4/1993 | European Pat. Off. . |
| 0537365A1 | 4/1993 | European Pat. Off. . |
| 0537788A3 | 4/1993 | European Pat. Off. . |
| 4120867A1 | 1/1993 | Germany . |
| 5-107712 | 4/1993 | Japan . |

*Primary Examiner*—D. Rutledge

*Attorney, Agent, or Firm*—Frishauf, Holtz, Goodman, Langer & Chick

[57] ABSTRACT

A photosensitive material processing apparatus for processing a photosensitive material such as a photographic film and a photographic print in use with a solid processing agent. The apparatus includes: a processing tank for processing the photosensitive material; a processing agent accommodating chamber for accommodating the solid processing agent; a pump for circulating a processing solution between the processing tank and the processing agent accommodating chamber; and a processing agent supply for supplying the solid processing agent to the processing agent accommodating chamber. The processing agent accommodating chamber includes a processing agent dissolving member which further includes a processing agent support member for supporting the solid processing agent. A sectional area of the processing agent support member is increased as it comes to a lower portion of the processing agent supporting member.

9 Claims, 17 Drawing Sheets

M1

M2

M3

PHOTOSENSITIVE MATERIAL PROCESSING APPARATUS IN USE WITH A SOLID PROCESSING AGENT

BACKGROUND OF THE INVENTION

The present invention relates to a photosensitive material processing apparatus, and more particularly relates to a photosensitive material processing apparatus for processing color films or color prints in which a solid processing agent is used for replenishing the processing agent.

As a means for making an automatic developing apparatus compact and also as a means for maintaining the environment to be clean and for saving natural resources by reducing an amount of use of plastic containers, techniques are disclosed, by which a processing agent for replenishment is condensed and solidified. For example, the technique is disclosed in Japanese Patent Publication Open to Public Inspection No. 5- 107712.

However, when a solid processing agent for replenishment is used, several problems may be encountered, and one of the problems is that the concentration of a processing solution can not be stabilized. In the case of a liquid processing agent for replenishment, the processing agent added into a processing tank is mixed with the existing processing solution when the processing agent is sent into a circulation passage. Therefore, the concentration can be made uniform in a short period of time, so that the concentration of the processing solution can be stabilized. On the other hand, in the case of a solid processing agent for replenishment, the processing agent charged into the processing solution is gradually dissolved. Therefore, the concentration of the processing solution is changed until the dissolution is completed. For this reason, the solid processing agent is disadvantageous in that the processing performance is difficult to be stabilized. Further, when the dissolution time is longer than the minimum time of the charging interval of the processing agent for replenishment, the solid processing agent for replenishment is accumulated in the processing tank.

SUMMARY OF THE INVENTION

The present invention has been achieved to solve the above problems. It is an object of the present invention to provide a photosensitive material processing apparatus characterized in that: a contact surface formed between a solid processing agent for replenishment and a member for holding the solid processing agent is reduced and placed in a flow of the processing solution so that the dissolution of the solid processing agent for replenishment is facilitated, and the quality of photosensitive material processing is stabilized.

The above object can be stabilized by the following means. That is, the present invention is to provide a photosensitive material processing apparatus comprising: a processing tank for processing the photosensitive material; a processing agent accommodating means which includes a processing agent dissolving means, for dissolving the supplied processing agent, having a processing agent support means provided with a support portion, the sectional area of which is increased as it comes to a lower portion; a pump means for circulating a processing solution between the processing tank and the processing agent accommodating means; and a processing agent supply means for supplying the processing agent to the processing agent dissolving means of the processing agent accommodating means.

Alternatively, the present invention is to provide a photosensitive material processing apparatus comprising: a processing tank for processing the photosensitive material; a processing agent accommodating means which includes a processing agent dissolving means, for dissolving the supplied processing agent, having a processing agent support means provided with a plurality of mesh members, the mesh size of which is reduced as it comes to a lower portion; a pump means for circulating a processing solution between the processing tank and the processing agent accommodating means; and a processing agent supply means for supplying the processing agent to the processing agent dissolving means of the processing agent accommodating means.

In this case, the photosensitive material is defined as a material having photosensitivity such as a common photographic film, photographic paper, X-ray film and the like. The processing agent is defined as a processing agent for processing the photosensitive material such as a granular, spherical, disk-shaped or grainy solid photosensitive material including a tablet and excluding a liquid processing agent. The processing agent dissolving means is defined as a means for accommodating a processing agent supplied to the automatic developing apparatus, and more particularly the processing agent dissolving means is defined as a means for dissolving a processing agent, wherein the processing agent dissolving means is communicated with a processing tank. The pump means is defined as a means for generating a liquid flow by pressurizing a processing solution. More particularly, the pump means is defined as a means for generating hydraulic pressure by which the processing solution is circulated to facilitate the dissolution of the processing agent. Either of a centrifugal pump, mixed flow pump or axial flow pump may be used for the pump means.

The processing agent support means is defined as a means for supporting a solid processing agent in the dissolving means for facilitating the dissolution of the processing agent so that a contact area formed between the processing agent and processing solution can be ensured. In the processing agent support means, a protruding support member is disposed, so that the processing agent can be received by an end of the protruding support member. In this connection, the support member is preferably formed into a circular cone or a pyramid. The processing tank is defined as a tank for processing the photosensitive material such as a developing tank, bleaching tank, fixing tank and washing tank. The processing agent blocking member is defined as a member such as a net of meshes, a slit or a board having holes by which the processing agent is prevented from moving to a portion except for the processing agent dissolving means.

Consequently, according to the photosensitive material processing apparatus of the present invention, an ideal liquid flow can be formed by the processing agent dissolving means. Since the liquid flow is effectively directed to the processing agent and the processing agent support means, the dissolution of the solid processing agent can be facilitated, and the residual solid processing agent does not stay in a lower portion of the dissolving section of the processing agent dissolving means.

BRIEF DESCRIPTION OF THE DRAWINGS

FIG. 18(A) is a longitudinally sectional view of the primary portion of another embodiment of the present invention.

FIG. 18(B) is a plan view of the uppermost mesh of the embodiment of FIG. 18(A).

FIG. 18(C) is a plan view of the middle mesh of the embodiment of FIG. 18(A).

DETAILED DESCRIPTION OF THE INVENTION

Figure 1:
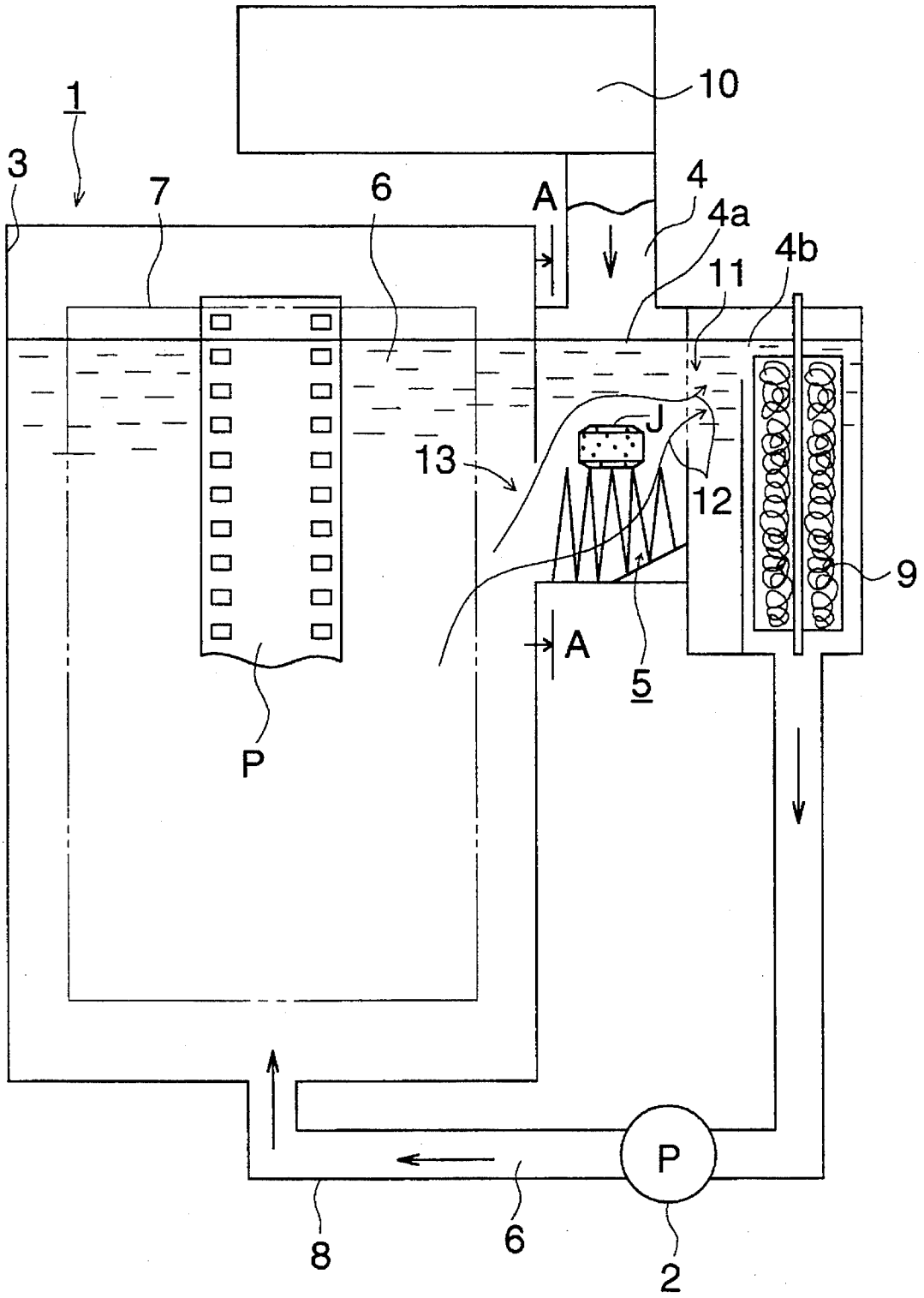
FIG. 1 is a sectional view of the developing tank of the first example of the present invention.

FIG. 1 is a sectional view of the developing tank of the color film photosensitive material processing apparatus. As illustrated in FIG. 1, the developing tank 1 includes: a processing tank 3 having a processing rack 7 for processing the photosensitive material P; a processing agent accommodating means 4 having a function to control the solution temperature at a constant value; and a pump means 2 for circulating the processing solution 6 between the processing tank 3 and the processing agent accommodating means 4. Further, the processing agent accommodating means 4 includes a dissolving section 4*a* and a filter section 4*b*. A processing agent J is charged from a processing agent charging unit 10 disposed at an upper position of the developing tank 1 to a dissolving section 4*a* of the processing agent accommodating means 4. The processing solution 6 is pressurized by the pump means 2 and moved along a circulation passage 8. Then, the processing solution 6 enters the processing tank 3. There is provided an opening 13 between the processing tank 3 and the dissolving section 4*a*, so that the processing solution 6 enters the dissolving section 4*a* of the processing agent accommodating means 4. Also, the processing solution 6 passes through the dissolving section 4*a* and then passes through an opening 11 provided between the dissolving section 4*a* and the filter section 4*b*. After that, the processing solution 6 flows into the filter section 4*b*. In this connection, in the dissolving section 4*a*, the processing solution 6 flows as illustrated by an arrow line 12 in FIG. 1. Due to the foregoing, the processing solution 6 is formed into a turbulent flow and blown against the processing agent J. Further, there is provided a processing agent support means 5 in the dissolving section 4*a* in such a manner that the processing agent support means 5 supports the processing agent J in a flow of the processing solution 6. Therefore, the dissolution of the processing agent J can be facilitated. The processing solution 6 in which the solid processing agent J is dissolved passes through a filter 9 provided in the filter section 4*b*. In this way, the processing solution 6 is filtered. After that, processing solution 6 is circulated again in the developing tank 1 by the pump means 2. In this connection, the photosensitive material P is conveyed to the following processing tank by a means (not shown) provided in the rack 7 of the processing tank 3.

Figure 2:
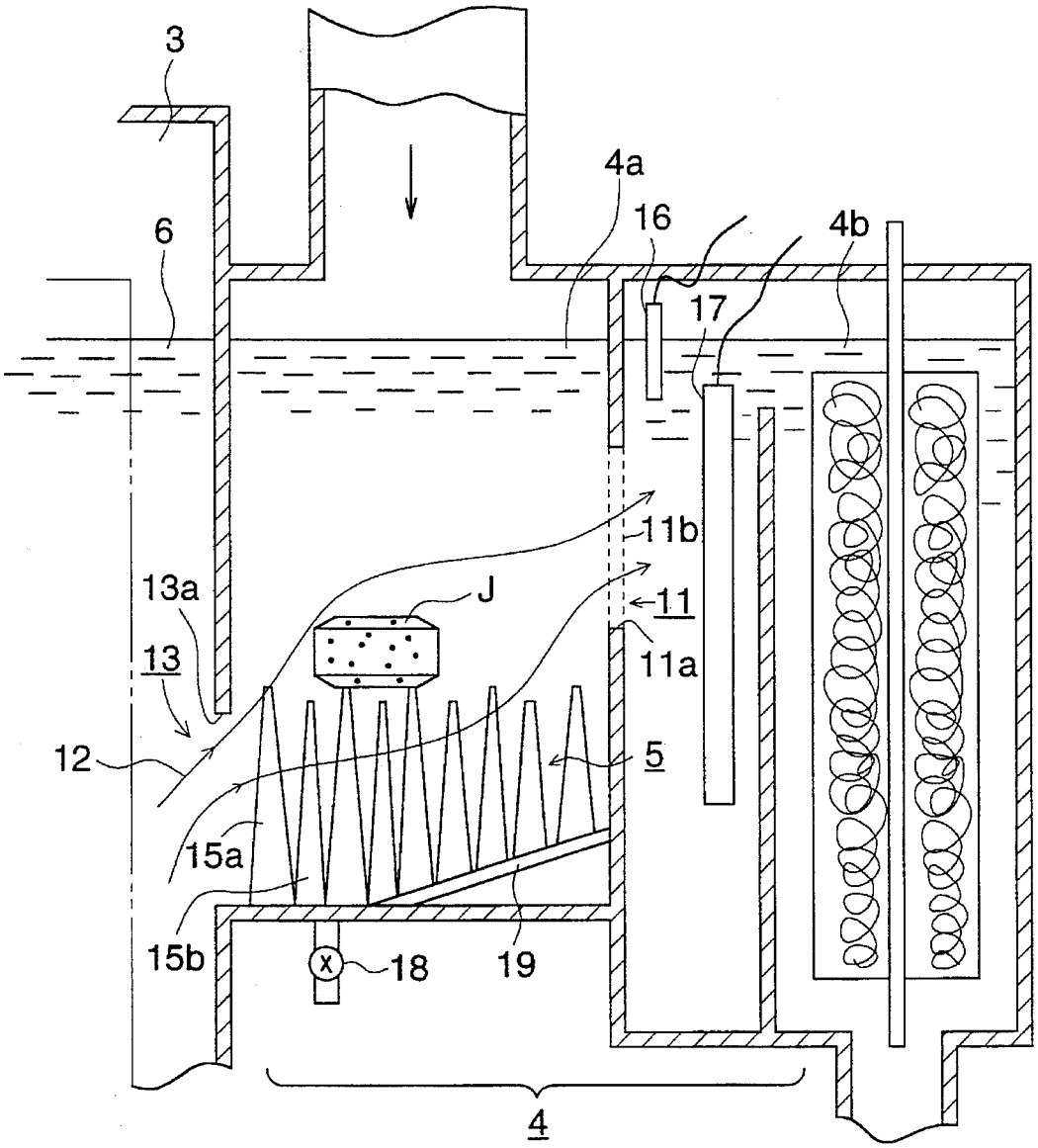
FIG. 2 is a longitudinally sectional view of the primary portion of FIG. 1.

FIG. 2 is a sectional view showing a primary portion of the apparatus in FIG. 1. In this example, the processing agent support means 5 of the dissolving section 4*a* is formed into a rod-shape and provided with a plurality of support sections 15*a* and 15*b*, the heights of which are different. These support members 15*a* and 15*b* are tapered. A drain 18 is a port through which a solution is discharged. An inclined plane 19 is provided for smoothing a flow of the processing solution in the dissolving section 4*a*. A heater 17 is provided for maintaining the temperature of the processing solution at a constant value. A level sensor 16 is provided for detecting the level of the solution.

Figure 18:
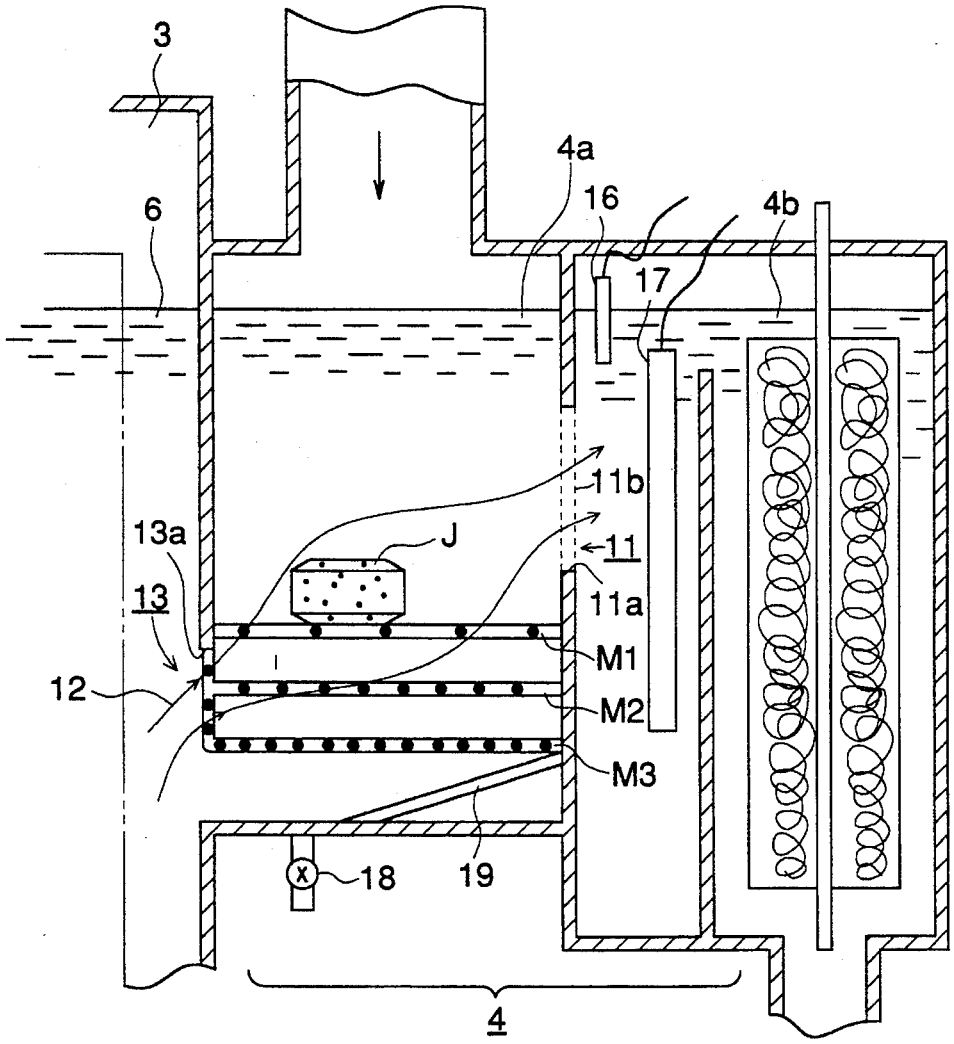
FIG. 18 (D) is a plan view of the lowermost mesh of the embodiment of FIG. 18(A).
Figure 18:
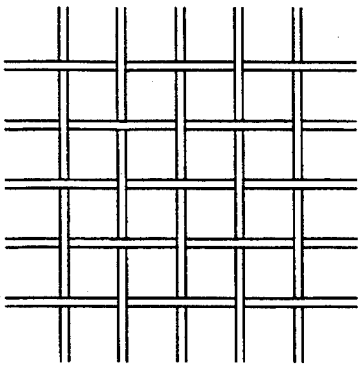
Figure 18:
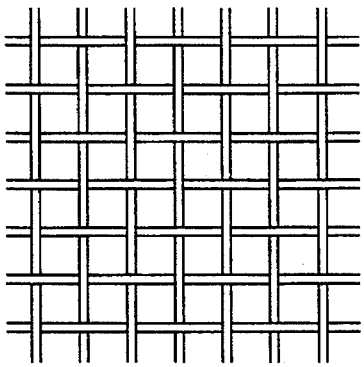
Figure 18:
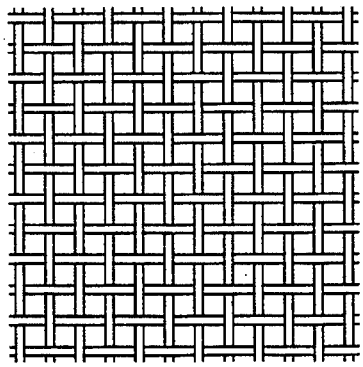

The processing agent support means of the present invention will be explained as follows. The processing agent support means is provided for supporting the solid processing agent in such a manner that a surface of the solid processing agent is not contacted with a bottom surface of the dissolving section. Specifically, a protruding support member is disposed on the bottom surface of the dissolving section, or a mesh-shaped filter is disposed in the dissolving section. It is preferable that a sectional area of the support member is increased as it comes to a lower position. Further, an interval between the upper surfaces of the support members are smaller than the maximum outer diameter of the solid processing agent. In the case where the processing agent support means is composed of a mesh member, (as shown in FIGS. 18(A)–18(D) it is preferable that a plurality of steps of mesh members are provided. In this case, it is preferable that the meshes at a lower position are smaller than the meshes at an upper position, as shown in FIG. 18(A). Due to the foregoing construction, it is possible to prevent a surface of the processing agent from coming into contact with the bottom surface of the dissolving section, so that an area in which the processing solution comes into contact with the processing agent can be ensured, and the dissolution can be facilitated. Even when the dimensions of the processing agent are reduced smaller than the interval between the upper surfaces of the support section as the processing agent is dissolved in the processing solution, since the sectional area of the support section is increased as it comes to a lower position, the processing agent can be held by the sides of the support section, so that the processing agent is not immediately contacted with the bottom surface of the dissolving section. Therefore, the contact area between the processing solution and the solid processing agent is not suddenly reduced. These circumstances are the same in the case of the processing agent support means having a mesh filter.

From the viewpoint described above, a preferable example of the support section of the processing agent support means is disclosed as shown by numerals 15*a* and 15*b* in FIG. 2. However, it should be noted that the present invention is not limited to the specific example.

An end surface 13*a* composes an upper end of the opening 13 communicating the processing tank 3 with the dissolving section 4*a*. It is preferable that the end surface 13*a* is set to be lower than the upper surface of the processing agent support means 5. An end surface 11*a* composes a lower end of the opening 11 communicating the dissolving section 4*a* with the filter section 4*b*. It is preferable that the end surface 11*a* is set higher than the upper surface of the support section of the processing agent support means 5.

Due to the foregoing construction, a solution flow is formed as illustrated in FIG. 2. Therefore, the solution flow is effectively directed to the processing agent and the processing agent support means. Consequently, not only the dissolution of the solid processing agent is facilitated but also the residual solid processing agent does not stay at a lower position of the dissolving section 4*a*.

Figure 3:
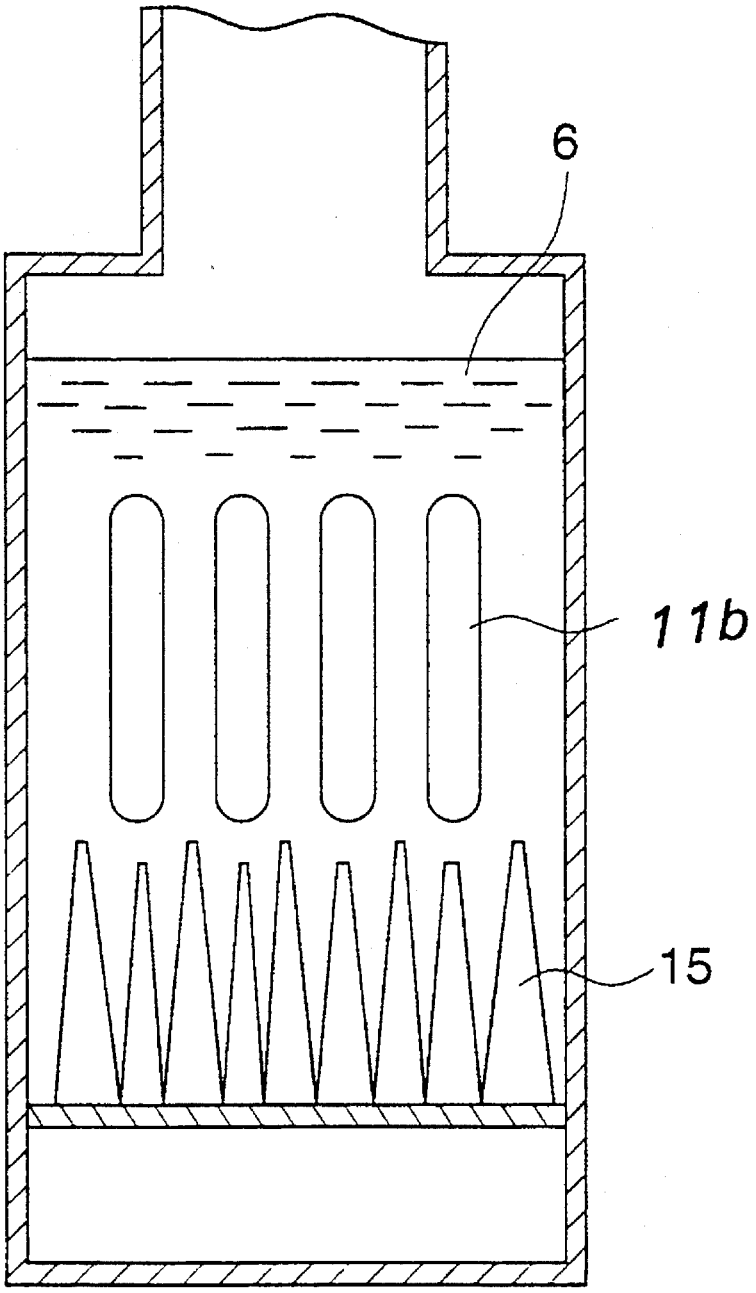
FIG. 3 is a laterally sectional view of the primary portion of FIG. 1.

FIG. 3 is a laterally sectional view taken on line A—A in FIG. 1, wherein a primary portion is shown in the drawing. As illustrated in FIG. 3, the processing agent blocking member 11*b* is disposed at the opening 11 formed between the dissolving section 4*a* and the filter section 4*b* so that the processing agent J can stay in the dissolving section 4*a* and can not move to other positions.

Figure 4:
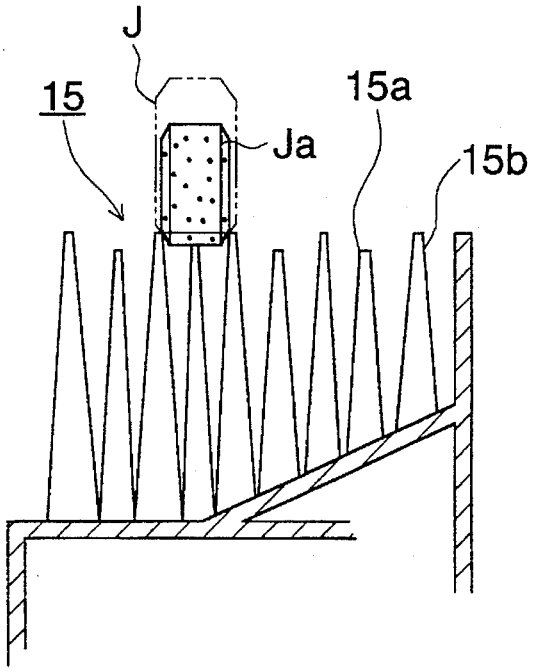
FIGS. 4(*a*) and 4(*b*) are longitudinally sectional views of the primary portion of FIG. 1.
Figure 4:
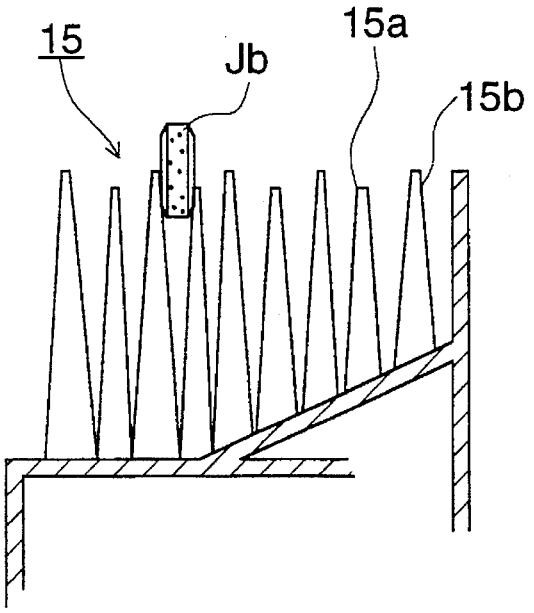

FIGS. 4(*a*) and 4(*b*) are sectional views of a primary portion of FIG. 1 which shows the following condition: After the solid processing agent J has been charged into the dissolving section 4*a*, a period of time passes and the dimensions of the processing agents $J_a$ and $J_b$ are reduced. Under the above condition, the processing agents $J_a$ and $J_b$ are held by the processing agent support means 5.

As can be seen from the drawing, the height of the support section 15*a* and that of the support section 15*b* of the processing agent support means 5 are different from each other. Due to the foregoing construction, it is possible to maintain the contact area between the solid processing agent J and the processing solution immediately after the solid processing agent J has been charged under the condition that the dimensions are large, and further it is possible to keep the solid processing agent J not to drop onto the bottom surface even when the dimensions of the solid processing agent J are reduced to some extent. When the dimensions of the solid processing agent J are reduced from the condition shown in FIG. 4(*a*) to the condition shown in FIG. 4(*b*), the solid processing agent J is interposed between the adjacent support sections of the processing agent support means 5. In this case, FIGS. 4(*a*) and 4(*b*) show a condition in which the solid processing agent J is held by the processing agent support means 5 in the longitudinal direction, however, it should be noted that the manner for supporting the solid processing agent J is not limited to the specific example.

Figure 17:
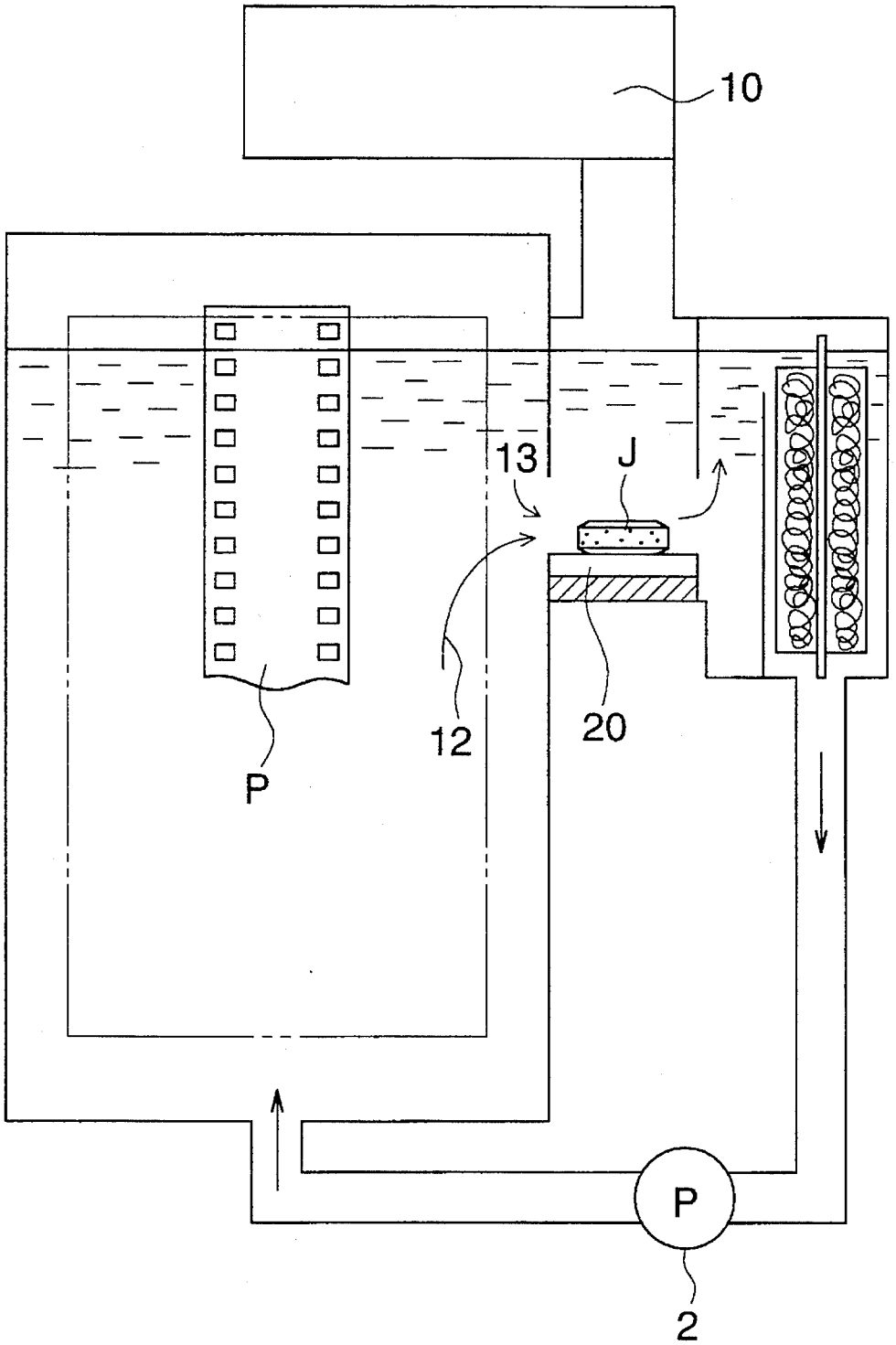
FIG. 17 PRIOR ART
FIG. 17 is a longitudinally sectional view of the comparative example.

FIG. 17 is a longitudinally sectional view of the comparative example used for making an evaluation of the effect of the present invention. As illustrated in FIG. 17, the processing agent J is put on the perforate-board-shaped protrusions 20.

The result of the comparison is shown in the following Table 1 which shows the results of a comparison experiment of the present invention and the conventional apparatus of FIG. 17 using the perforate-board-shaped protrusion 20. The ratio % shows the value of the ratio % obtained by the equation:

Ratio (%)={(dissolving time of the conventional apparatus−dissolving time of the apparatus of the present invention)/(dissolving time of the conventional apparatus)}×100.

In other words, the ratio is the value representing how fast the apparatus of the present invention can dissolve the solid processing agents in comparison to the dissolving speed of the agents with the conventional apparatus.

TABLE 1

| Item | Color Development | Bleaching | Fixing | Remark |
|---|---|---|---|---|
| Perforate-board-shape | 16 | 46 | 20 | Comparative Example |
| Present Invention | 11 | 30 | 18 | Example of Invention |
| Ratio % | 31 | 35 | 10 | |

As illustrated in the Table 1, excellent results were provided according to the present invention.

Figure 5:
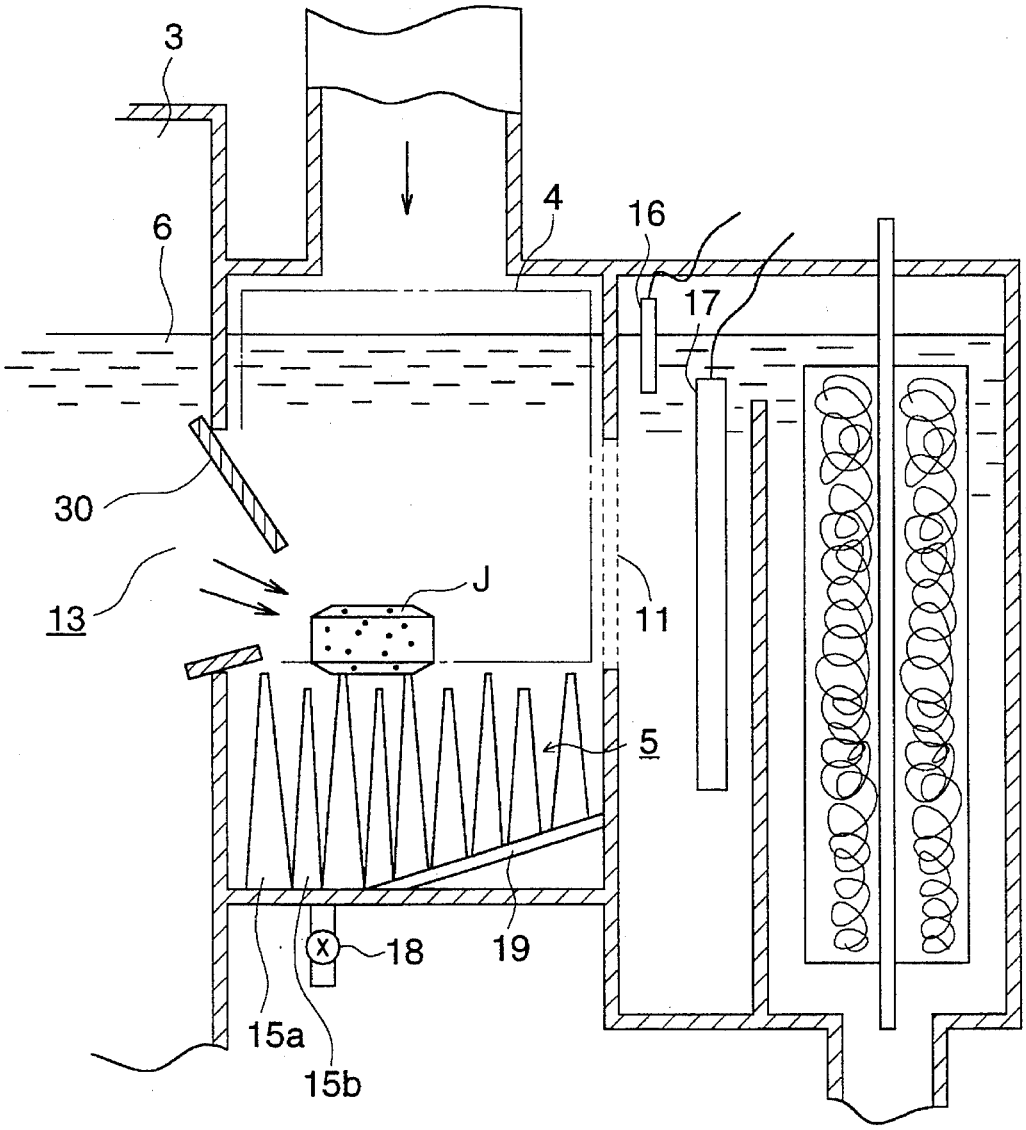
FIG. 5 is a sectional view of the developing tank of the second example of the present invention.

FIG. 5 is a view showing the second example. Like parts in each of FIGS. 2 and 5 are identified by the same reference character. As illustrated in FIG. 5, the flow speed of the processing solution is increased by the action of the nozzle member 30. A flow of the solution, the speed of which has been increased, is spurted to the processing agent J, so that the dissolution can be facilitated. This nozzle member 30 may be provided at the opening 13 shown in FIG. 30. Consequently, when the above construction is adopted, not only the dissolution of the solid processing agent is facilitated but also the residual solid processing agent does not stay at a lower position of the processing agent accommodating means 4. According to the nozzle member of the present invention, a diameter of the opening on the delivery side is smaller than that of the opening on the entry side. When the nozzle member is constructed in the above manner, the flow speed can be increased on the delivery side of the nozzle.

The first and second examples are constructed as described above. Therefore, the following effects can be provided.

The contact area between the processing agent and the processing solution is reduced, so that the dissolution of the processing agent can be facilitated by the flow of the solution. Accordingly, the photosensitive material can be quickly processed, and the image quality can be stabilized.

A sectional area of the portion of the processing agent dissolving means which holds the processing agent is gently reduced as it comes to an end of the portion, so that the dissolving property can be enhanced. In the case where the dimensions of the processing agent are reduced in the process of the dissolution, the processing agent does not immediately drop onto the bottom portion, because the rod-members are tapered, and the processing agent stays at the tapered portion. Therefore, the dissolution can be further facilitated. When a flow of the processing solution is sent from the side, it tends to be directed to the processing agent.

When a plurality of rod members of the processing agent dissolving means are provided, the heights of which are different, the contact area of the rode members and the processing agent can be reduced and the dissolving property can be enhanced.

Intervals of the ends of the plurality of rod members of the processing agent dissolving means are smaller than the minimum size of the processing agent. Therefore, the processing agent can be held on the ends of the rod members.

There is provided a means for preventing the processing agent from moving to a position which is not predetermined. Therefore, the processing agent can be charged at a predetermined position.

The ends of the plurality of rod members are set to be higher than an upper portion of the opening from which the processing solution flows into the dissolving section, and also set to be lower than a lower portion of the opening from which the processing solution flows out. Accordingly, the processing solution flows smoothly.

Figure 6:
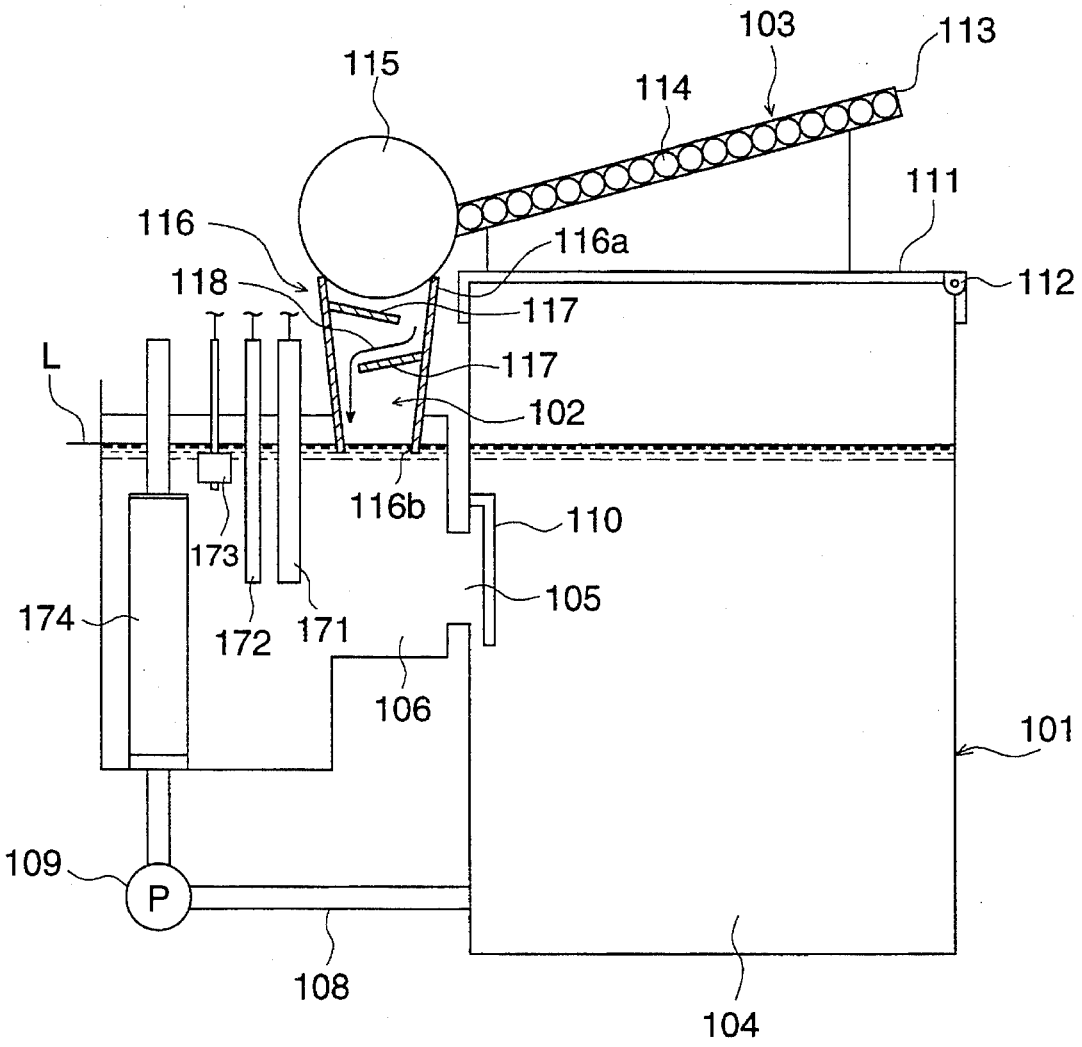
FIG. 6 is a schematic illustration of the photosensitive material processing apparatus of the third example of the present invention.
Figure 7:
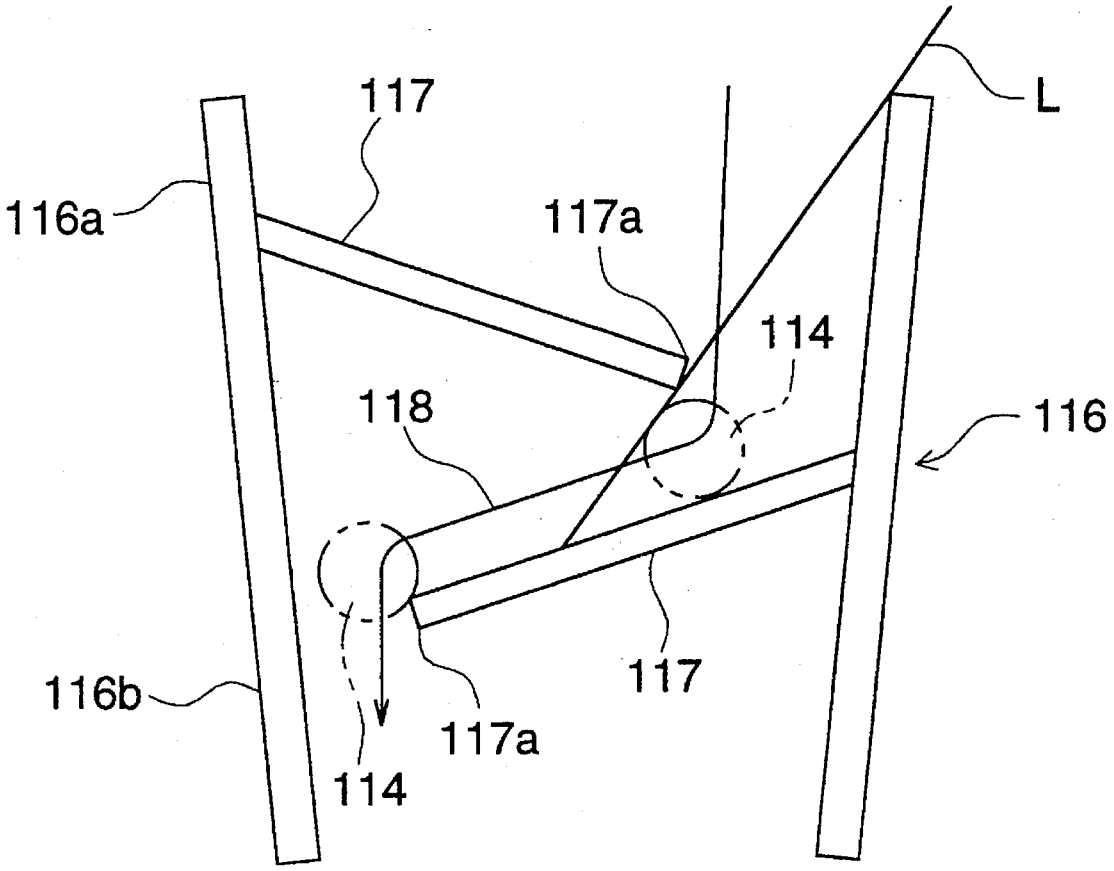
FIG. 7 is an enlarged view of the opening portion of the processing tank of the photosensitive material processing apparatus of the third example of the present invention.
Figure 8:
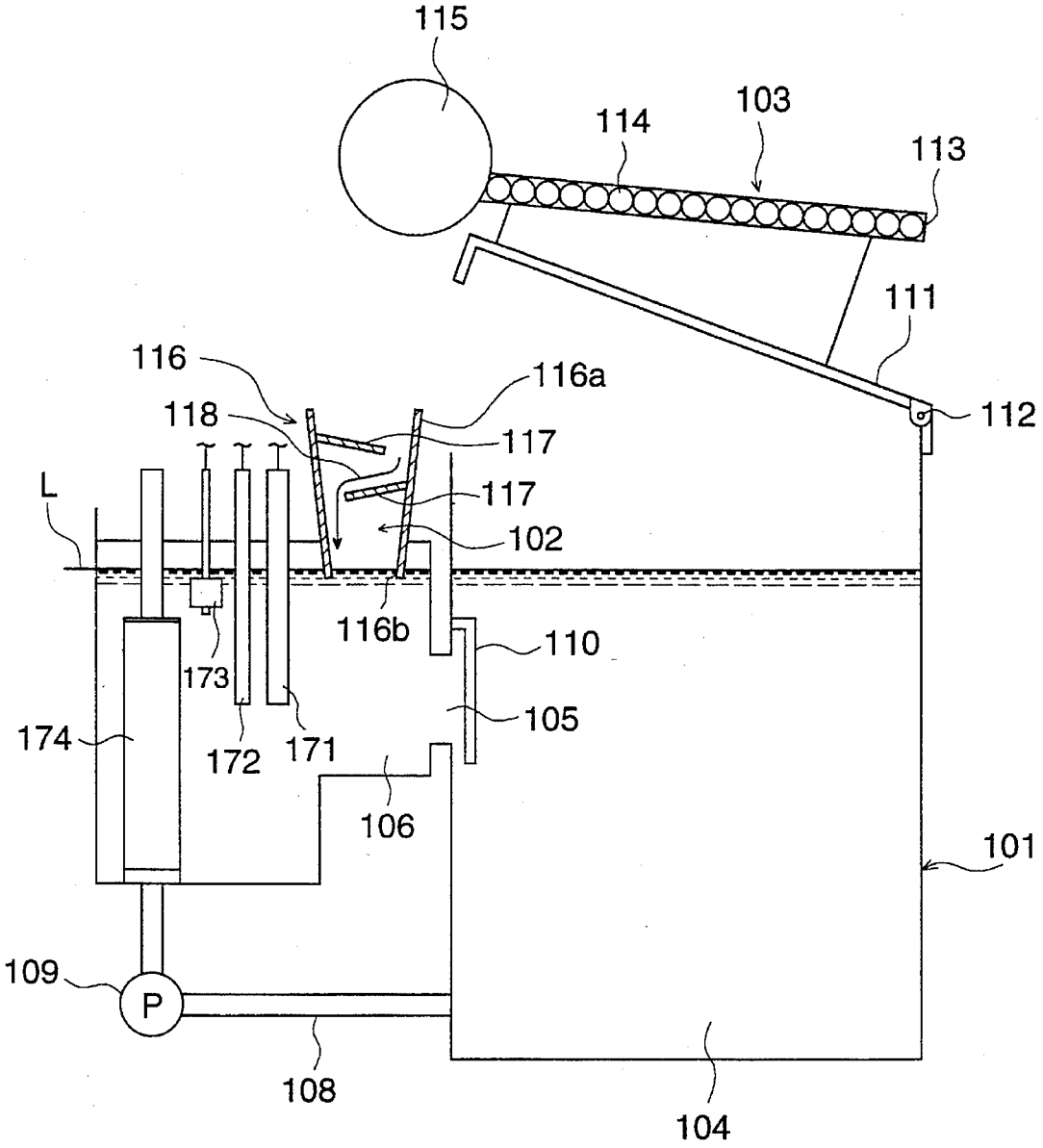
FIG. 8 is an arrangement view of the photosensitive material processing apparatus of the third example of the present invention.

The third example of the photosensitive material processing apparatus of the present invention will be explained as follows. FIG. 6 is a schematic illustration showing the construction of the photosensitive material processing apparatus. FIG. 7 is an enlarged view of the chute of the opening of the processing tank. FIG. 8 is a view showing a condition in which the cover of the photosensitive material processing apparatus is opened.

The photosensitive material processing apparatus includes: a processing tank 101 for developing exposed photosensitive materials; an opening portion 102 through which a solid processing agent for replenishment is charged into the processing tank 101; and a supply section 103 for supplying the solid processing agent for replenishment to this opening portion 102. This processing tank 101 includes: a processing section 104 for developing exposed photosensitive materials; and a constant temperature section 106 communicating with this processing section 104 through the communicating port 105. There is provided an opening 102 for charging the solid processing agent for replenishment to the constant temperature section 106. The constant temperature section 106 includes a heater 171, temperature sensor 172, level sensor 173, and filter 174. According to the information provided by the level sensor 173, the heater is operated and the processing solution can be maintained at a predetermined temperature. When a level of the processing solution is lowered exceeding a predetermined position, the heater operation is stopped in accordance with the information given by the level sensor 173. The constant temperature section 106 and the processing section 104 are connected by the circulation pipe 108. Therefore, when the circulation pump 109 is driven, the processing solution passes through the filter 174 and is supplied to the processing section 104 through the circulation pipe 108. In this way, the processing solution circulates between the constant temperature section 106 and the processing section 104.

At the communicating port 105 between the processing section 104 and the constant temperature section 106, there is provided a shading plate 110 for shading a beam of light sent from the constant temperature section 106, wherein the processing agent can be circulated through the shading plate 110. Although circulation of the processing agent is allowed by this shading plate 110, a beam of light sent from the constant temperature section is shaded by the shading plate 110, so that the shading property of the processing tank can be ensured and the occurrence of fog on the photosensitive material can be prevented.

The supply section 103 is provided on the cover 111 which covers an upper portion of the processing section 104 of the processing tank 101. This cover 111 is capable of being opened upward by the action of the hinge 112. In a cartridge 113 of this supply section 103, the solid processing agent for replenishments are accommodated. When the charging drum 115 is rotated, for example, a piece of solid processing agent for replenishment 114 or two pieces of solid processing agent for replenishment 114 are supplied each time.

There is provided a chute 116 at the opening 102 of the constant temperature section 106. A lower end portion **116*b* of this chute 116 is disposed at a position lower than the processing solution level L in the constant temperature section 106. By the devices described above, the solid processing agent for replenishment 114 is charged into the constant temperature section 106 from the chute 116. In this case, the lower end portion 116*b* of the chute 116 is disposed at a position lower than the processing solution level L in the constant temperature section 106. Accordingly, even if the processing solution splashes when the solid processing agent for replenishment 114 is charged, the splash can be restricted inside the chute 116, so that the inside of the constant temperature section 106** is not stained with the deposition of the processing solution.

The chute 116 includes a stepwise passage 118 composed of not less than two shading members 117 which are alternately inclined downward, and the solid processing agent for replenishment 114 is charged through the stepwise passage 118. In this example, two steps of shading members 117 are disposed, however, it should be noted that the present invention is not limited to the specific example, and the number of steps of shading members may be not less than two. In this case, the parts are disposed in such a manner that a tangent L connecting an upper end **116*a* of the chute 116 with an end 117*a* of the uppermost shading member 117 on the passage 118 side crosses with the successive shading member 117**.

In this way, the solid processing agent for replenishment 114 is charged from the chute 116 into the constant temperature section 106 of the processing tank 101. In the chute 116, the passage 118 is formed between not less than two steps of shading members 117 which are inclined downward, and the solid processing agent for replenishment 114 passes through this passage 118 so as to be charged. Accordingly, the drop speed of the solid processing agent for replenishment 114 is reduced by the stepwise passage 118 formed in the chute 116. Therefore, the splash of the processing solution can be prevented.

It is possible to prevent the deposition of the processing solution inside of the chute 116 by the stepwise shading member 117, the number of the steps of which is not less than two, when the solid processing agent for replenishment 114 is charged and the processing solution is splashed.

Further, the parts are disposed in such a manner that a tangent L connecting an upper end **116*a* of the chute 116 with an end 117*a* of the uppermost shading member 117 on the passage 118 side crosses with the successive shading member 117. Accordingly, even when a beam of light leaks from a gap formed between the upper end 116*a* of the chute 116 and the charging drum 115 of the supply section 103, or even when a beam of light enters when the cover 111 is opened as shown in FIG. 8**, the light shading property can be ensured, so that the occurrence of fog can be prevented.

The light shading member 117 is inclined by an angle of 10° to 30° with respect to the horizontal line. For example, when the shading member 117 is inclined by an angle not more than 10° with respect to the horizontal line, the solid processing agent for replenishment 114 does not drop smoothly. On the other hand, when the shading member 117 is inclined by an angle not less than 30° with respect to the horizontal line, the light shading property can not be competently provided.

When the light shading member 117 is inclined by an angle of 10° to 30° with respect to the horizontal line as described above, the solid processing agent 114 for replenishment smoothly drops in the passage 118 formed between the light shading members 117, the number of steps of which is not less than two, and at the same time the light shading property can be ensured with respect to a beam of light sent from the outside of the apparatus, so that the occurrence of fog can be prevented.

In the chute 116, the reflectance of a surface of the chute 116 or the shading member 117 is not more than 30%. Therefore, a beam of light sent from the outside of the apparatus is absorbed in the chute 116, so that the light shading property can be ensured and the occurrence of fog can be prevented.

The supply section 103 is provided on the cover 111 which covers an upper portion of the processing section 104 of the processing tank 101. This cover 111 is capable of being opened upward by the action of the hinge 112. When this cover 11 is opened upward as illustrated in FIG. 8, the supply section 103 is separated from the chute 116, so that the chute 116 can be easily detached and simply washed.

Figure 9:
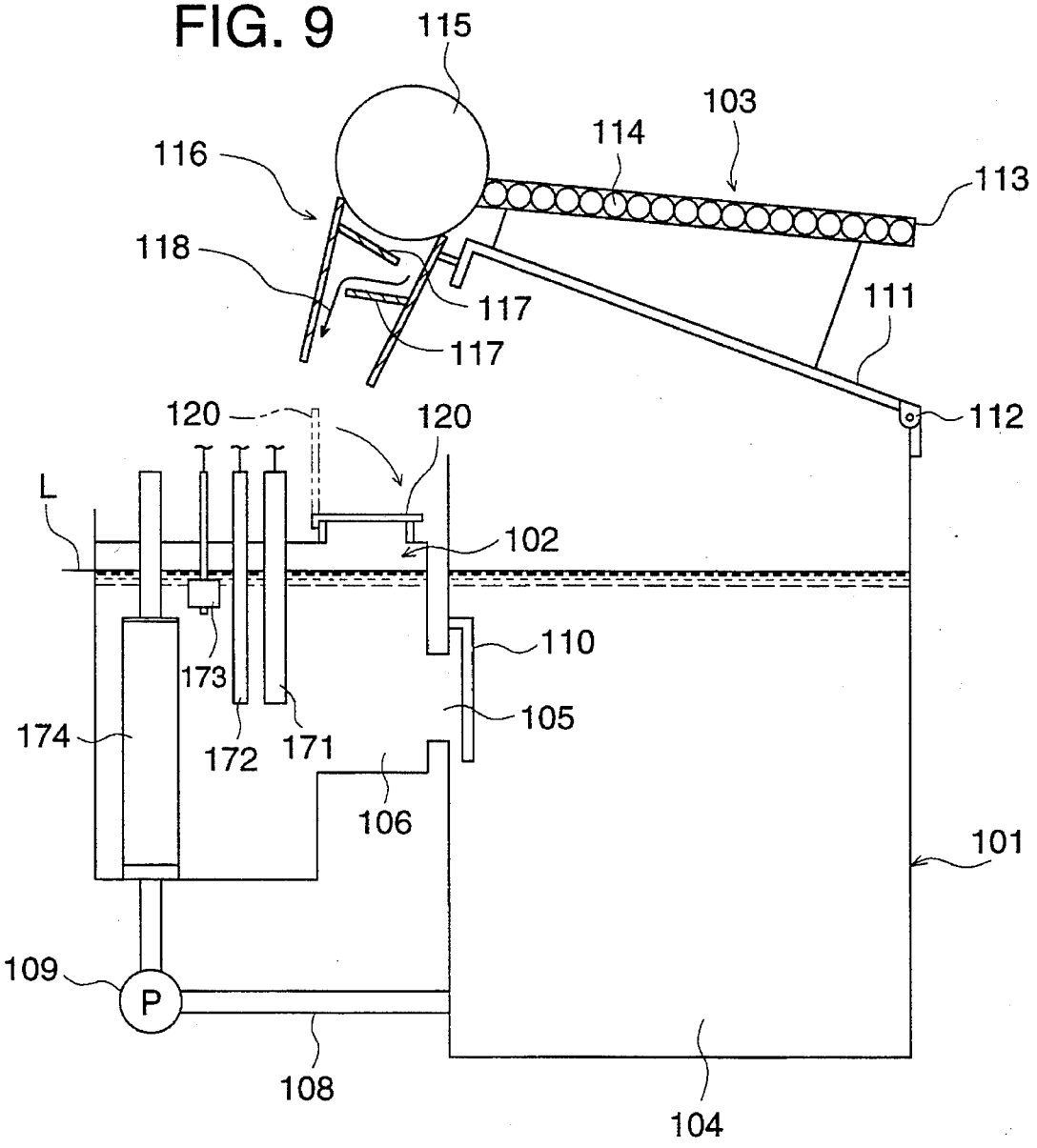
FIG. 9 is a schematic illustration of the photosensitive material processing apparatus of the fourth example of the present invention.

FIG. 9 is a schematic illustration showing the construction of the fourth example of the photosensitive material processing apparatus of the present invention. Like parts in each of FIGS. 6 to 8 are identified by the same reference character, and the explanations will be omitted here. There is provided a chute 116 in the opening 102 of the constant temperature section 106 of the processing tank 101 of this example. The chute 116 is fixed to the cover 111, so that the chute 116 is opened and closed together with the cover 111. In the constant temperature section 106 of the processing tank 101, there is provided a lid 120 for covering the opening 102. When the cover 111 is opened, the lid 120 covers the opening 102, so that foreign objects are prevented from entering the constant temperature section 106 of the processing tank 101 through the opening 102.

Figure 10:
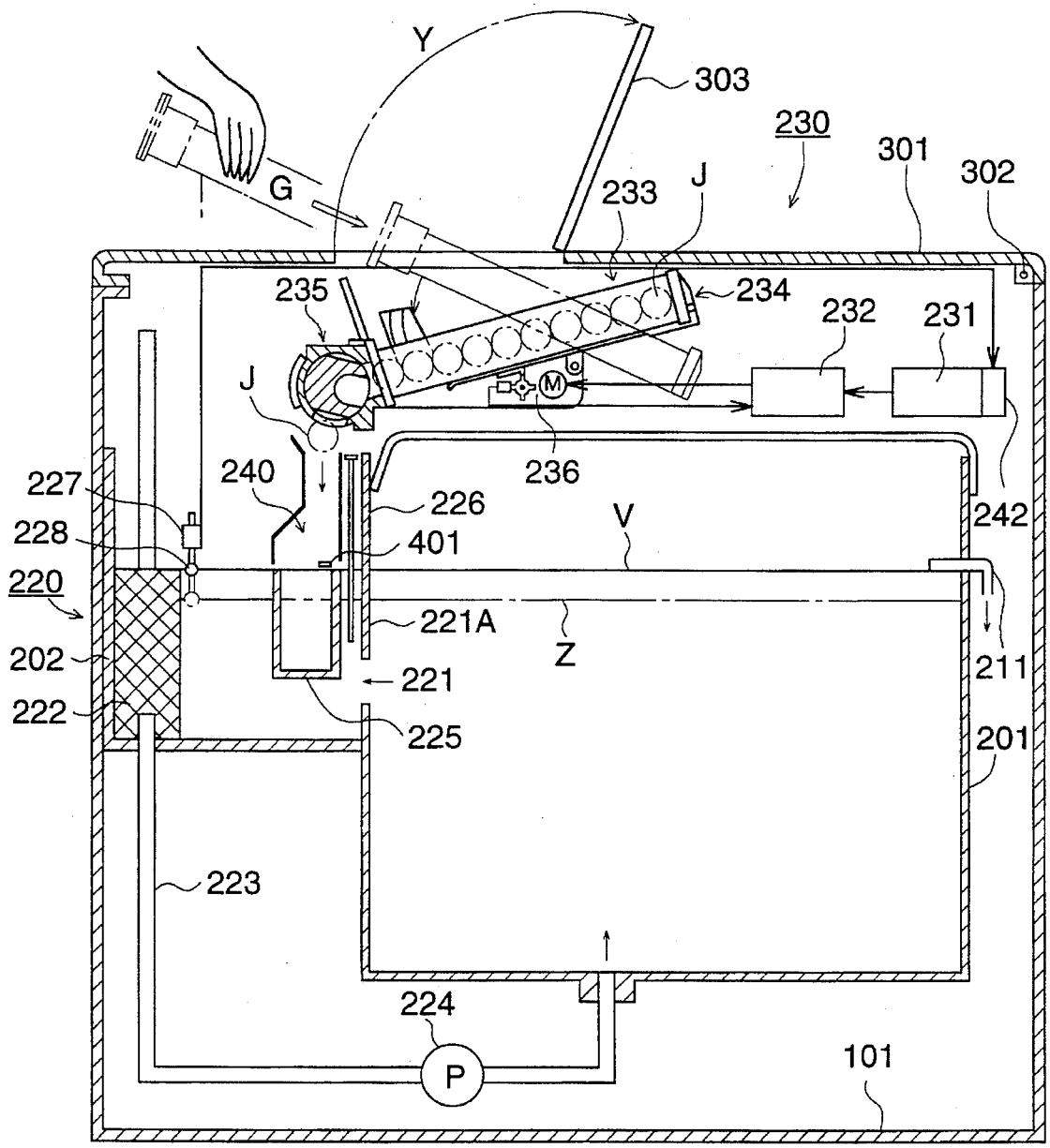
FIG. 10 is a sectional arrangement view of the primary portion of the photosensitive material processing apparatus of the fifth example of the present invention.

FIG. 10 is a sectional view showing a construction of the primary portion of the fifth example of the present invention. In each of the color developing tank, the bleaching fixing tank and the stabilizing tank, there is provided a dissolving tank 202 which is a solid processing agent charging section communicated with each processing tank. In this example, the dissolving tank 202 functions as a constant temperature tank. In this connection, the function of the dissolving tank and that of the constant temperature tank may be separated, and the dissolving tank 202 and the constant temperature tank may be separately provided. In this example, a processing solution communicates through the processing tank 201 and the dissolving tank 202, however, it is possible to install the charging section in the processing tank 201 so that the two tanks can be integrated into a single tank. Since the construction of the bleaching fixing tank and that of the stabilizing tank are the same as the construction of the color developing tank, the following explanations of the processing tank 201 can be applied to all of the color developing tank, bleaching fixing tank and stabilizing tank. In this connection, a conveyance unit for conveying the photosensitive material is omitted in the drawing.

The processing tank 201 is provided for processing the photosensitive material. A solid processing agent replenishing section 230 for replenishing a solid processing agent (a tablet in this example) J, and a dissolving tank 202 (202A, 202B, 202E) are integrally provided outside of a partition wall forming the processing tank 201. The dissolving tank 202A, (not shown) is attached to the color developing tank 201A, and the dissolving tanks 202B, 202E (not shown) are respectively attached to the bleaching fixing tank 201B and the stabilizing tank 201E. The processing tank 201 and the dissolving tank 202 are separated from each other by a partition wall 221A on which a communicating window 221 is formed, so that the processing solution can communicate through the communicating window 221. A processing agent charging section 220 of the dissolving tank 202 includes a reception enclosure 225 for receiving a solid processing agent J which is disposed under the level of the processing solution in the dissolving tank 202, so that the solid processing agent J can not be moved in the processing tank 201 in a solid form. In this connection, the reception enclosure 225 is composed of a net-shaped or filter-shaped material through which the processing can pass, however, the solid processing agent J can not pass through it until it is completely dissolved. An opening is formed, which receives the solid processing agent J charged by the solid processing agent replenishing section 230. Instead of providing the reception enclosure 225, a net-shaped or filter-shaped member may be provided in the communicating window 221 so that the solid processing agent J can not be moved from the dissolving tank 202.

The processing agent supply means will be explained as follows. A solid processing agent replenishing section 230, which is a portion of the processing agent supply means, is provided at an upper position of the processing tank. The solid processing agent replenishing section 230 includes a solid processing agent accommodating container 233, solid processing agent charging section 234, solid processing agent supply section 235, and drive section 236, wherein the solid processing agent replenishing section 230 is tightly covered with an upper cover 301. The upper cover 301 is pivotally connected with a support shaft 302 provided at the rear of the main body accommodating the processing tank 201 and the dissolving tank 202. A skylight 303 is pivotally connected with a portion on the upper surface of the upper cover 301. When the skylight 303 is opened in the direction of Y shown by a one-dotted chain line in the drawing, the solid processing agent accommodating container 233 can be attached or replaced. The solid processing agent accommodating container 233 shown by a one-dotted chain line is charged in the direction of arrow G and then rotated counterclockwise so that the solid processing agent supply section 235 coincides with an opening of the solid processing agent accommodating container 233. When the solid processing agent accommodating container 233 is inclined to a position indicated by a solid line in the drawing, the solid processing agents J in the accommodating container are contacted with the solid processing agent supply section 235 by the action of their own weight. The solid processing agent accommodating container 233 accommodates the solid processing agents J to be charged into the processing tank later.

Next, a buffer means will be explained below. The buffer means 240 is formed into a cross-beam shape. When the solid processing agent J is charged from the solid processing agent supply section 235, a shock caused by the solid processing agent J is absorbed by the buffer means 240, so that the occurrence of splash can be avoided. In this connection, various variations may be adopted with respect to this buffer means, and the area, position and attaching angle can be appropriately changed. Alternatively, a slope may be provided in the buffer means, so that the solid processing agent J reaches a surface of the processing solution under the condition that the solid processing agent J is inclined. A buffer member 401 is fixed onto the wall surface. It is preferable that the buffer means is made of rubber, polyvinyl chloride (PC and vinylchloride). In the case where rubber is used, silicon rubber is preferably used which does not absorb the solution, and Neoprane rubber is most appropriate since it is difficult for Neoprene rubber to absorb the solution and further it is difficult for Neoprene rubber to be denatured.

An arrangement of the buffer means 240 will be explained below. The level of the solution is changed when water in the solution evaporates, the solution is conveyed to the following processing tank, and water is replenished to the solution. Therefore, the level of the solution changes in a range from the uppermost level V to the lowermost level Z. Consequently, the buffer means 240 is disposed at a position where the buffer means 240 is always located above the level of the processing solution.

The operation will be described here. First, the solid processing agent J is charged from the solid processing agent supply section 235. The dropping speed of the solid processing agent J is reduced by the action of the buffer member 401, and the solid processing agent is charged into the processing solution while the occurrence of a splash can be avoided.

It is preferable that the buffer member is subjected to fluorine coating. In the case where the buffer means is made of resilient material, consideration is given to the resilient deformation of the buffer member caused when the solid processing agent J collides with it, and the buffer member is fixed at a position where the buffer member is not dipped in the solution even when it is deformed.

Figure 11:
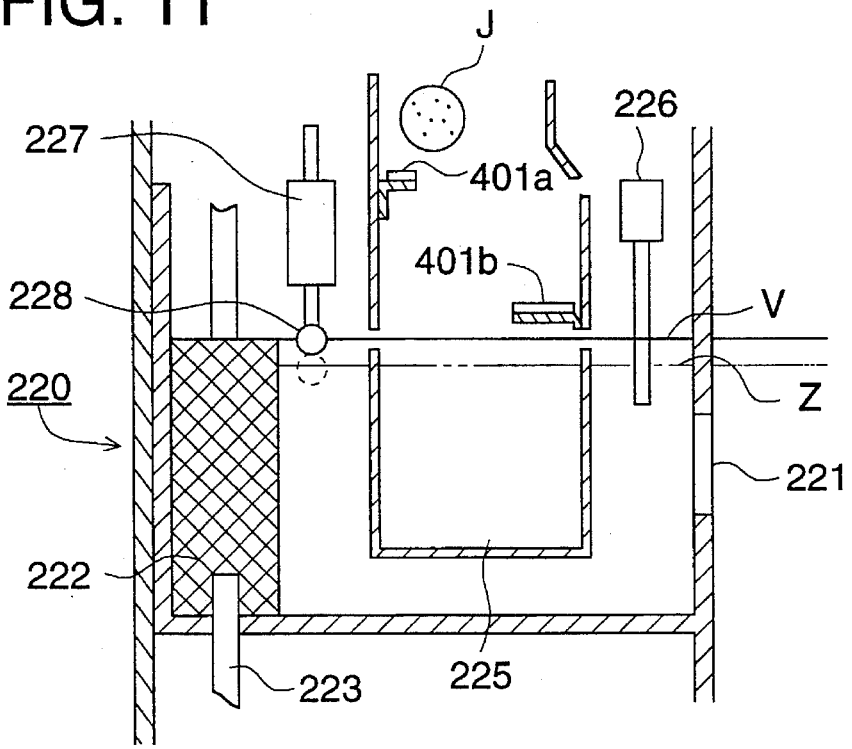
FIG. 11 is a sectional view of the primary portion of the photosensitive material processing apparatus of the sixth example of the present invention.

FIG. 11 is a sectional view of the primary portion of the sixth example of the present invention. As illustrated in the drawing, cross beam members 401*a* and 401*b* are provided as a buffer means. The cross beam members 401*a* and 401*b* are disposed in parallel with the level of the solution, so that a splash of the solution can be blocked. An interval of the cross beam members 401*a* and 401*b* is smaller than the dimensions of the tablet of processing agent, so that the solid processing agent J can not be held between the cross beam members 401*a* and 401*b*.

In the case where the solid processing agent J is formed into a disk-shape or a doughnut-shape, it is necessary that other members are not located in a range of $(4r^2+h^2)^{1/2}$, wherein $2r$ is the diameter, and h is the thickness of the solid processing agent. When a plurality of buffer means are provided, a shock caused when the solid processing agent collides with the buffer means can be reduced, and the generation of waves on the surface of the processing solution can be prevented.

Figure 12:
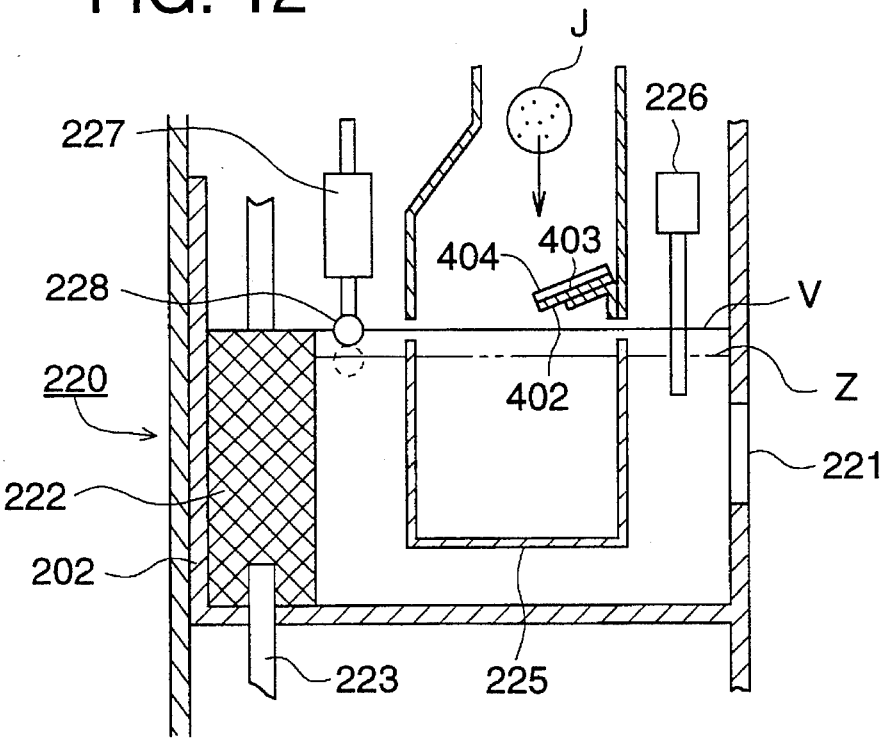
FIG. 12 is a sectional view of the primary portion of the photosensitive material processing apparatus of the seventh example of the present invention.

FIG. 12 is a sectional view of the primary portion of the seventh example of the present invention. As shown in the drawing, a buffer member 402 is provided. The buffer member 402 is diagonally disposed with respect to the level of the solid solution, so that the occurrence of a splash can be avoided. A flat-plate-shaped rib portion 404 is provided on a surface 403 of the buffer means. The reason why the rib portion 404 is provided is as follows: Even when the processing solution adheres onto the surface 403 by dew condensation, it is difficult for the processing solution to adhere onto the rib portion 404 protruding from the surface 403. Therefore, the solid processing agent J can be prevented from slipping down on the buffer member 402 since the processing solution is not deposited on the surface. It is preferable that the solid processing agent J is subjected to surface processing such as fluorine coating so that the solid processing agent J can easily slip on the surface.

Figure 13:
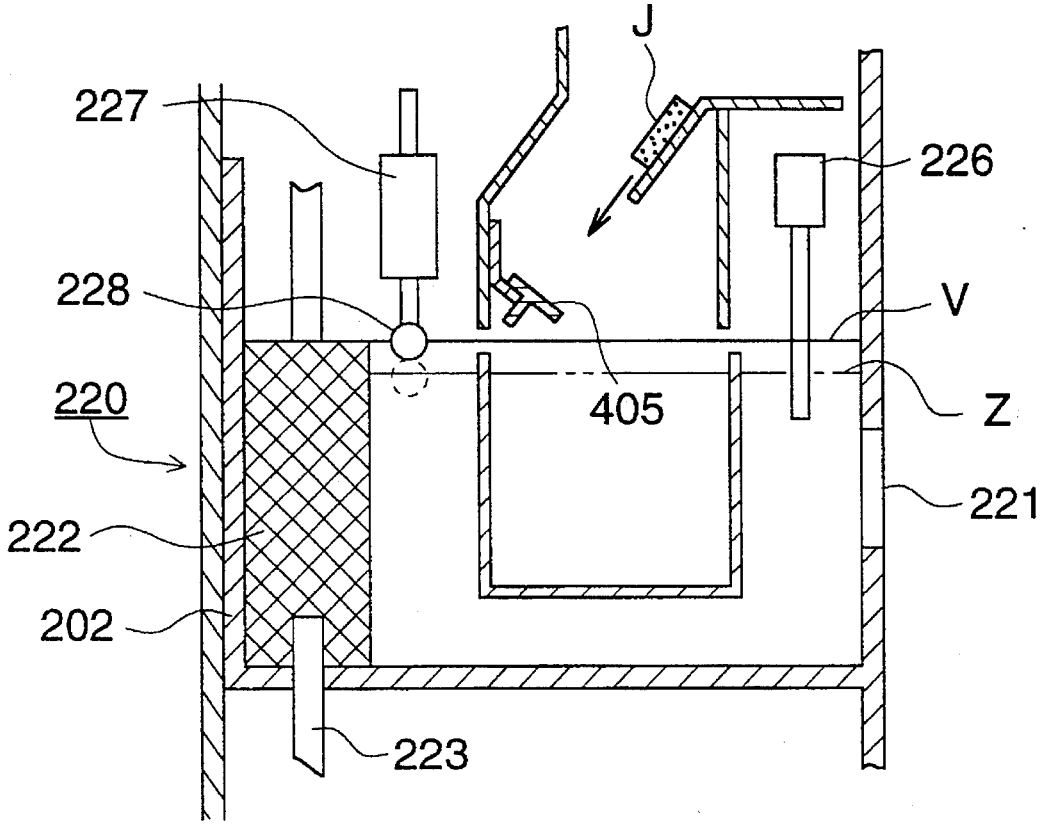
FIG. 13 is a sectional view of the primary portion of the photosensitive material processing apparatus of the eighth example of the present invention.

FIG. 13 is a sectional view of the primary portion of the eighth example of the present invention. As illustrated in the drawing, a buffer member 405 is provided as a buffer means. The buffer member 405 is diagonally disposed with respect to the level of the solution, so that the occurrence of a splash can be prevented. In this example, a diagonally located chute is used so as to reduce the speed of the solid processing agent J, and then a shock is absorbed by the buffer means of the present invention. The buffer member 405 is located on a locus of the solid processing agent J. In the drawing, a vertical section in the longitudinal direction of the cross beam is formed into a T-shape.

The profile of the buffer means 405 is not limited to a T-shape. Of course, the profile of the buffer means 405 may be formed circular, triangular, L-shaped and the like. A protruding portion of the T-shaped or the L-shaped buffer means prevent the deflection of the buffer means when the solid processing agent J collides with the buffer means. Concerning the aforementioned plate-shaped buffer means 405, for example, lattice-shaped ribs may be provided so as to prevent the deflection.

Figure 14:
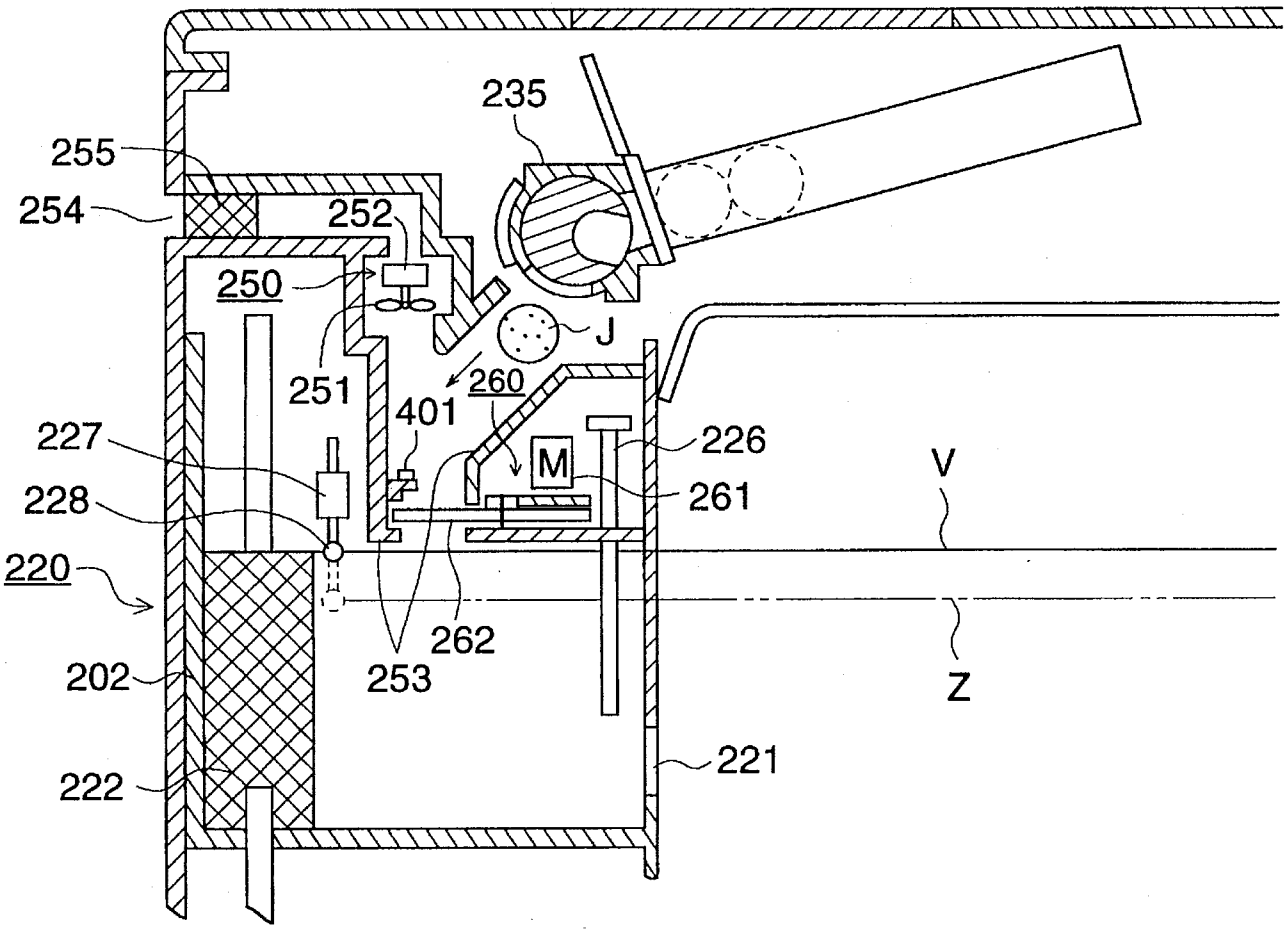
FIG. 14 is a sectional view of the primary portion of the photosensitive material processing apparatus of the ninth example of the present invention.

FIG. 14 is a sectional view of the primary portion of the ninth example of the present invention. As illustrated in the drawing, the processing agent supply means includes a solid processing agent supply section 235 by which the solid processing agent J is charged into the processing solution. The level control means includes a level sensor 227 by which the level of the processing solution is controlled to a predetermined level. The buffer means is located at a position higher than the uppermost level of the processing solution controlled by the level control means. The buffer means includes a buffer member 401 by which the charging speed of the solid processing agent can be reduced. The closing means includes a casing 253 by which the atmosphere of the processing solution can be closed up. The exhaust means includes a ventilating fan 250 by which the atmosphere of the solid processing agent supply section is ventilated to a portion separated from the processing agent supply means. The ventilating fan 250 is located above the dissolving tank. A propeller 251 is used for exhausting the atmosphere in the casing. A propeller drive motor 252 is used for rotating the propeller. An exhaust port 254 is used for exhausting the atmosphere in the casing to the outside of the automatic developing apparatus. A filter 255 is used for preventing foreign objects from entering through the exhaust port 254. The tightly opening and closing means 260 includes a shielding plate 262 which is opened in the case of exhausting and closed in the case of stoppage. The shielding plate 262 is opened for ventilation when the propeller is rotated. The shielding plate 262 is closed for air-tightly sealing the casing 253 when the exhausting operation is stopped. When the solid processing agent J is charged, the shielding plate 262 is moved by the shielding plate drive motor 261 so that a hole formed on the shielding plate 262 can be moved and the solid processing agent J can pass through the hole. When the charging operation is stopped, the hole is moved so as to seal the solid processing agent supply section 235 for preventing the deposition of the vapored component on the exhaust fan 250 and the solid processing agent supply section 235.

The operation will be described below. First, the shielding plate 262 is opened, and the ventilating fan 250 is operated. Next, the solid processing agent J is charged from the solid processing agent supply section 235. The charging speed of the solid processing agent J is reduced by the buffer member 401, and the solid processing agent J is charged into the processing solution without the occurrence of a splash. After that, the shielding plate 262 is closed, and the ventilating fan 250 is stopped. Since vapor is difficult to reach the solid processing agent J, it does not swell, and positively drops into the solution.

The shielding plate 262 may be constructed in such a manner that a hole is formed on a rectangular plate capable of sliding. Alternatively, the shielding plate 262 may be constructed in such a manner that it can be opened and closed on a locus of the solid processing agent J. Concerning the casing 253, it may function as an external cover of the automatic developing apparatus. In the case of dew condensation, the exhaust fan 250 may be provided and the atmosphere in the automatic developing apparatus may be exhausted.

Further, a cover member having a hinge at its upper position may be attached at a boundary portion between a cavity portion vertically extending from the processing tank to the exhaust fan 250 and an inclined portion on which the processing agent is lowered. In this case, the cover member allows the processing agent J to drop into the processing solution, however, the vaporized component sent from a lower position is prevented by the cover member from entering the inclined portion on which the processing agent is lowered.

Next, the tenth example of the present invention will be explained as follows.

Figure 15:
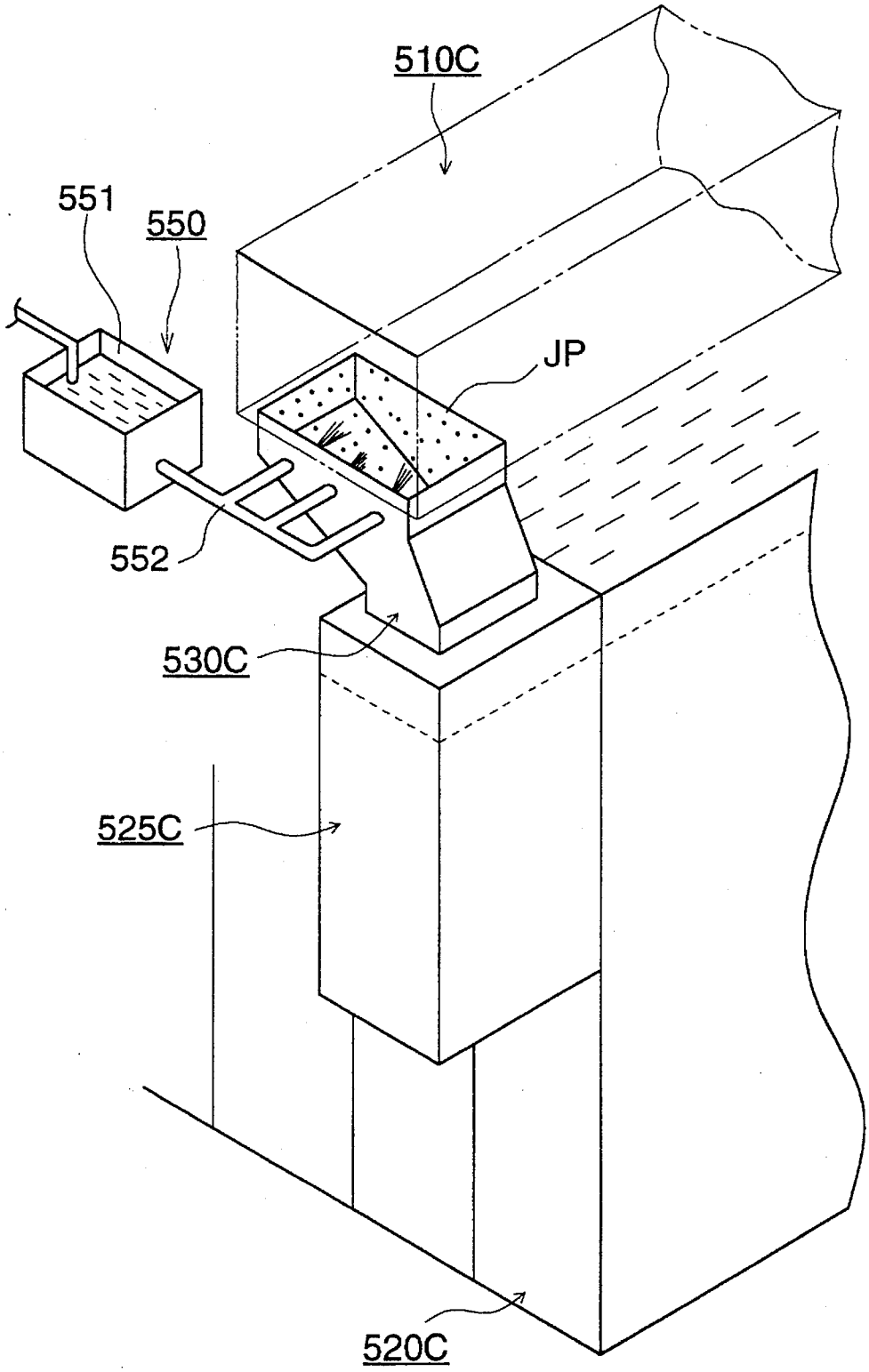
FIG. 15 is a perspective view of the primary portion of the photosensitive material processing apparatus of the tenth example of the present invention.

FIG. 15 is a perspective view showing an outline of the primary portion of the photosensitive material processing apparatus for color print use in which a solid processing agent is used. The present invention is applied to the processing tank 520C and the dissolving tank 525C. The solid processing agent replenishing device 510C is used for replenishing a solid processing agent. The dissolving tank 525C is disposed close to the processing tank being communicated with each other. The processing tank 520C is used for processing the photosensitive material. The chute means 530C is used for conveying the solid processing agent between the solid processing agent replenishing device 510C and the dissolving tank 525C. The washing means 550 is used for washing objects adhering onto the inner wall of the chute. The water supply tank 551 is used for supplying water used for cleaning the inner wall of the chute. The water supply pipe 552 is used for supplying water from the water supply tank to the chute. The deposition JP is powder of the solid processing agent adhering onto the inside of the chute.

The operation will be explained below. Water is supplied from the water supply tank 551 and passes through the water supply pipe 552. Then the supplied water is jetted to the inner wall of the chute so that the deposition on the inner wall is washed away. As a result, it is possible to prevent the reduction of the passage in the chute caused by the deposition JP. It is also possible to prevent the difficulty of charging the solid processing agent into the dissolving tank 525C, the difficulty being caused by an increased frictional coefficient. In this case, washing water is also used as replenishing water to be replenished to the processing tank. An amount of replenishing water is about 10 cc per one operation, which is competent for washing. As described above, the solid processing agent can be positively charged into the processing tank, and the solid processing agent replenishing device can be effectively disposed in a spare space in the photosensitive material processing apparatus, so that the overall apparatus can be made compact.

Next, the eleventh example of the present invention will be explained below.

Figure 16:
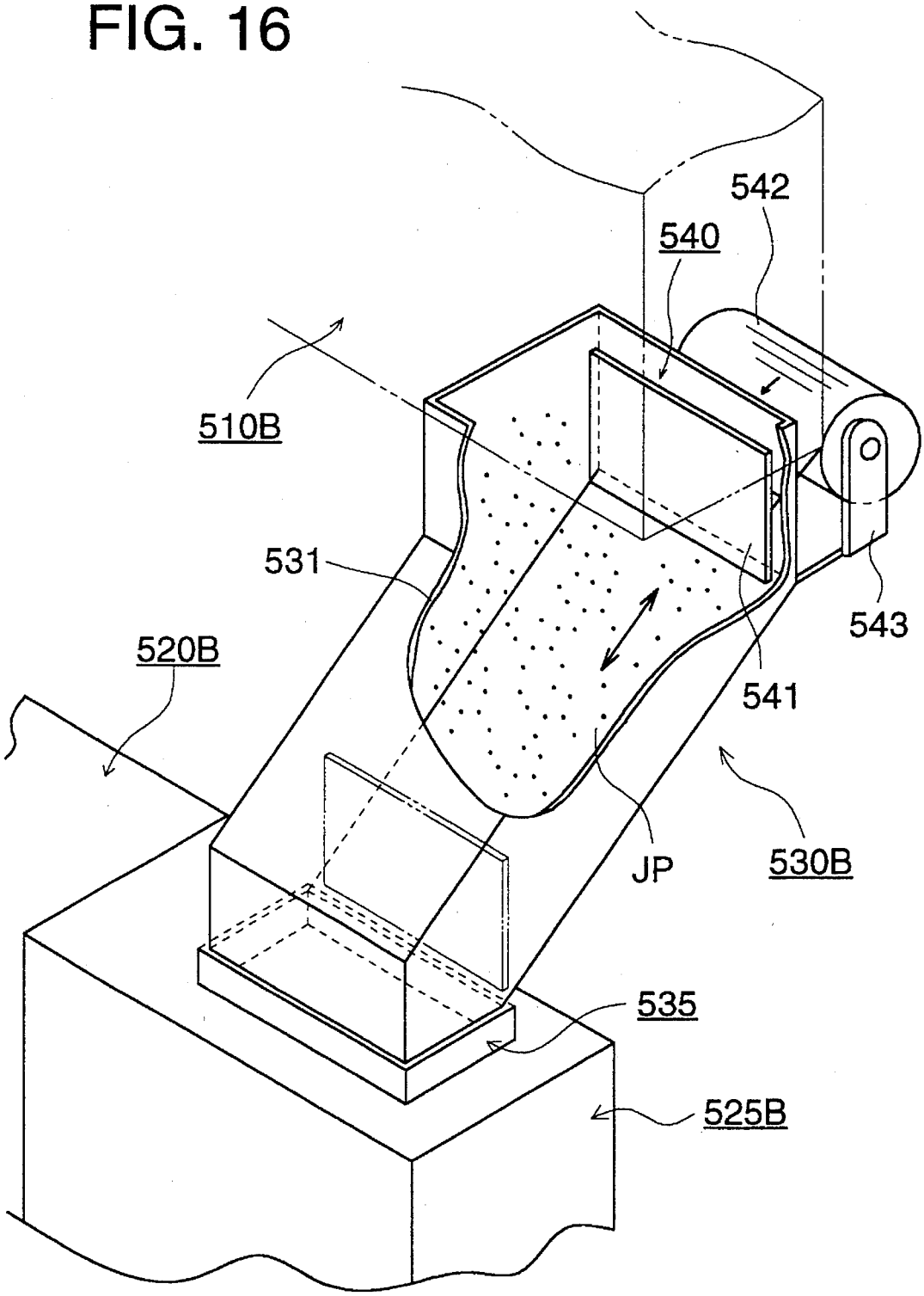
FIG. 16 is a perspective view of the primary portion of the photosensitive material processing apparatus of the eleventh example of the present invention.

FIG. 16 is a perspective view showing an outline of the primary portion of the photosensitive material processing apparatus for color print use in which a solid processing agent is used. As shown in the drawing, the solid processing agent replenishing device 510B is used for replenishing a solid processing agent. The dissolving tank 525B is used as a dissolving tank for bleaching and fixing. The processing tank 520B is used for bleaching and fixing the photosensitive material. The chute means 530B is a chute for conveying the solid processing agent between the solid processing agent replenishing device 510B and the dissolving tank 525B. The casing 531 is used for the chute means. The cleaning means 540 is moved in the chute so that the deposition can be removed by the blade 541. The leaf spring 542 is used for activating the blade 541. The support plate 543 is used for supporting a shaft of the leaf spring 542. Two-dotted chain line in FIG. 16 shows a condition in which the blade 541 is lowered.

The operation will be explained here. When the leaf spring 542 is moved by a motor not shown, the blade 541 is moved on the inner wall so that the deposition is removed. In this way, it is possible to prevent the reduction of the passage formed by the inner walls in the chute caused by the deposition. Therefore, it is also possible to prevent the difficulty of charging the solid processing agent into the processing tank. In this connection, the chute attachment and detachment section 535 is used for attaching and detaching the chute.

It is preferable to make the blade 541 of silicon rubber, the hardness of which is 30 70, because silicon rubber is resistant to chemicals and not deteriorated with time. Not only silicon rubber but also Neoprene rubber is used, and it is possible to apply various variations. The present invention is not limited to the blade, but a brush type may be applied while it is rotated for cleaning the inner wall. In order to move the blade in parallel with the inner wall of the chute, a guide rail may be provided on an upper surface of the inner wall.

As explained above, it is possible to positively charge the solid processing agent. It is also possible to dispose the solid processing agent replenishing device in a spare space of the apparatus, so that the overall apparatus can be made compact.

What is claimed is:

1. A photosensitive material processing apparatus for processing a photosensitive material with a solid processing agent, comprising:

a processing tank for processing the photosensitive material;

a processing agent accommodating means for making a processing solution, including:

a processing agent dissolving means for dissolving the solid processing agent;

said processing agent dissolving means including a processing agent support means for supporting said solid processing agent wherein a sectional area of said processing agent support means is increased as it comes to a lower portion of said processing agent supporting means;

a pump means for circulating said processing solution between said processing tank and said processing agent accommodating means; and a processing agent supply means for supplying said solid processing agent to said processing agent dissolving means of said processing agent accommodating means.

2. The photosensitive material processing apparatus of claim 1, wherein said processing agent support means has a plurality of bar-shaped supporting portions.

3. The photosensitive material processing apparatus of claim 2, wherein said bar-shaped supporting portions of said processing agent support means are tapered.

4. The photosensitive material processing apparatus of claim 3, wherein a maximum outer size of said solid processing agent is larger than an interval between one of said bar-shaped supporting portions and a neighboring one of said bar-shaped supporting portions.

5. The photosensitive material processing apparatus of claim 4, wherein heights of said plurality of bar-shaped supporting portions are different from each other.

6. The photosensitive material processing apparatus of claim 1, wherein said processing agent accommodating means further includes a filter means for preventing said solid processing agent from flowing out from said processing agent dissolving means while said pump means circulates said processing solution to flow in a sequence of said processing tank, said processing agent dissolving means, and said filter means; and said processing agent support means supports said processing agent in the flow of said processing solution.

7. The photosensitive material processing apparatus of claim 6, further comprising:

a first opening means provided between said processing tank and said processing agent dissolving means; and a second opening means provided between said processing agent dissolving means and said filter means;

wherein heights of said bar-shaped supporting portions are higher than an upper end of said first opening means and lower than a lower end of said second opening means.

8. The photosensitive material processing apparatus of claim 1, further comprising:

a first opening means provided between said processing tank and said processing agent dissolving means; and a nozzle member, located at said first opening means, for guiding a flow of said processing solution from said processing tank to said processing agent dissolving means.

9. A photosensitive material processing apparatus for processing a photosensitive material with a solid processing agent, comprising:

a processing tank for processing the photosensitive material;

a processing agent accommodating means for making a processing solution, including:

a processing agent dissolving means for dissolving the solid processing agent;

said processing agent dissolving means including a processing agent support means for supporting said solid processing agent with a plurality of mesh members wherein a mesh size of said mesh members is reduced as it comes to lower portion of said processing agent supporting means;

a pump means for circulating said processing solution between said processing tank and said processing agent accommodating means; and a processing agent supply means for supplying said solid processing agent to said processing agent dissolving means of said processing agent accommodating means.

* * * * *